US006163998A

United States Patent [19]

James

[11] Patent Number: 6,163,998

[45] Date of Patent: Dec. 26, 2000

[54] BACKING AND SUPPORT ASSEMBLY FOR A DECORATIVE ELEMENT

[75] Inventor: Anthony James, Birmingham, United Kingdom

[73] Assignee: Austral Holdings Limited, NR Castletown, United Kingdom

[21] Appl. No.: 09/208,311

[22] Filed: Dec. 11, 1998

[51] Int. Cl.[7] ..... A47G 1/16

[52] U.S. Cl. ..... 40/755; 40/750

[58] Field of Search ..... 40/748, 750, 752, 40/754, 755, 774, 729

[56] References Cited

U.S. PATENT DOCUMENTS

| | | | |
|---|---|---|---|
| 2,419,823 | 4/1947 | Cross et al. | 40/753 |
| 3,545,115 | 12/1970 | Nichols | 40/750 |
| 4,622,767 | 11/1986 | Sullivan | 40/753 X |
| 4,830,404 | 5/1989 | Lu | 40/729 X |
| 5,303,487 | 4/1994 | Olson | 40/753 X |
| 5,950,341 | 9/1999 | Cross | 40/750 |

*Primary Examiner*—Terry Lee Melius
*Assistant Examiner*—James M Hewitt
*Attorney, Agent, or Firm*—Young & Thompson

[57] ABSTRACT

A one-piece backing and support assembly, for use in mounting photographs and the like, includes a flat backing panel having an elongate support leg partly cut out from the panel, and two stays on either side of the leg, also partly cut out from the panel and integrally connected at their lower ends to the panel and at their upper ends to side tabs on the support leg, intermediate its ends. The upper end of the support leg is detachably engageable with partly cut out tags on the panel located to hold the support leg and stay in positions where they each extend angularly away from the panel so as to support it at an angle on a horizontal surface. Integrally formed at one side of the backing panel is an apertured frame panel which is folded across the backing panel and secured, leaving an edge slot through which a photograph may be inserted between the panels, so as to be visible through the aperture in the frame panel.

16 Claims, 2 Drawing Sheets

BACKING AND SUPPORT ASSEMBLY FOR A DECORATIVE ELEMENT

BACKGROUND OF THE INVENTION

1. Field of the Invention

The invention relates to backing and support assemblies for decorative elements and particularly to assemblies for supporting photographs or other small pictures upstanding on a horizontal surface.

2. Description of Related Art

One common type of assembly for this purpose comprises a flat panel to which is hingedly connected a support leg so that the leg can be extended at an angle to the panel so as to rest on a supporting surface and hold the panel at an appropriate angle. One such form of assembly is shown in British Patent No. 2216410 where the support leg is connected to the panel by an elongate stay the lower end of which is hingedly connected to the panel and the upper end of which is hingedly connected to a location on the support leg intermediate its upper and lower ends. The upper end of the support leg is then detachably engageable with a formation on the panel which retains the leg in position at an angle to the panel so that the lower end of the support leg can rest on the horizontal supporting surface. British Patent No. 2216410 describes an arrangement where such an assembly provides a backing for a rectangular rigid picture frame.

While such an arrangement is very effective and provides a stable support for a picture frame, there is a requirement for a backing and support assembly which is cheaper and easier to manufacture by being formed in one piece from a single panel, and also where a frame for a photograph may be incorporated in the panel itself. For example, it is common practice for photographers to visit schools, universities and similar establishments to take photographs of the students and then to supply mounted copies of the photographs at comparatively low cost. It is desirable to supply each photograph mounted in such a way that it may be displayed upstanding on a horizontal surface without the necessity of mounting the photograph in a comparatively elaborate free-standing frame. In a preferred embodiment of the present invention, therefore, the backing and support assembly is further provided with means for mounting a photograph, or other picture, on the assembly in an attractive manner, but at low cost.

Low cost self-supporting card mounts for photographs are known, but in the known arrangements the support leg usually comprises a simple elongate portion which is cut out from the panel so as to remain hingedly connected to it at its upper end. The leg is then simply bent at an angle, out of the plane of the panel, so that its lower end can rest on the horizontal surface on which the mount is to stand. However, such arrangements tend to be comparatively fragile and unstable and, due to the necessary geometry, hold the mount at a lower angle than is optimally desirable.

The present invention sets out to provide an improved form of assembly where these disadvantages may be overcome.

However, the backing and support assembly according to the present invention may also be used as a backing and support for other forms of decorative element. For example, since it may be cheaply manufactured in one piece, it may provide a backing and support assembly for low cost disposable items such as greeting cards and similar decorative items. Also, although the backing and support assembly according to the present invention is particularly suitable for such low cost uses, there is no reason why the assembly of the present invention might not also be used in more elaborate devices, for example as a backing panel and support assembly for a conventional photograph frame of wood, metal, plastics or other material from which such frames are conventionally made.

SUMMARY OF THE INVENTION

According to the invention, therefore, there is provided a one-piece backing and support assembly for a decorative element, comprising a flat backing panel which provides an elongate support leg cut out from the panel and having upper and lower ends, and at least one stay also cut out from the panel and integrally connected at its lower end to the panel and at its upper end to a part of the support leg intermediate the ends thereof, the upper end of the support leg being detachably engageable with a formation on the panel in a manner to retain the support leg and stay in erected positions where they each extend angularly away from the panel.

Since the support leg and stay are integral with the panel, and cut out from it, the panel, support leg and stay may all be formed in a single cutting or stamping operation from a single sheet of material and no further operations are required to attach the support leg and stay to each other and to the panel. The assemblies may therefore be readily manufactured in large quantities at low cost. Conveniently the panel may be formed from compressed fibreboard or card, although it could also be formed from any other bendable sheet material.

The part of the support leg to which the upper end of the stay is integrally connected may comprise a tab projecting laterally from the side of the support leg. There may be provided two such stays cut out from the panel at opposite sides of the support leg. This arrangement provides for great stability of the leg when in the erected position, with little tendency of the leg to twist relative to the panel. The upper end of the support leg may be formed with a projection which, in the erected position of the leg, is engageable within a cut-out portion of the panel. The cut-out portion of the panel may be formed from at least one tag which is partly cut from the panel and, when bent out of the plane of the panel, reveals said cut-out, whereby the projection on the support leg passes beneath the tag.

The upper end of the support leg may be wider than a lower neck portion of the support leg, so that in the erected position of the leg the sides of the wider upper end thereof move downwardly and overlap and are engageable with, a portion of the panel from which said lower neck portion of the leg was cut.

Preferably the support leg extends angularly across the panel and is formed at the lower end thereof with edge portions respectively extending generally parallel to two adjacent side edges of the panel. This allows the support leg to support the panel with either of said side edges horizontal. This facility is particularly useful in the case where the panel is rectangular and oblong, since it allows a photograph or other picture mounted on the assembly to be displayed either in portrait or in landscape orientation.

Preferably one of the panel and support leg is formed with a recess adjacent the junction with the other, to facilitate lifting of the support leg from the plane of the panel.

In any of the above arrangements the panel is preferably pre-creased, to form a hinge, at each junction between the stay and the support leg and between the stay and the panel.

The invention includes within its scope a backing and support assembly of any of the kinds referred to above when combined with a decorative element connected to the backing panel so as to overlie at least a part of one face of the panel. The decorative element may comprise a decorative further panel, which may have an outer contour which is the same size and shape as the outer contour of the backing panel. The decorative panel may include an internal aperture so as to define a frame for a further decorative sheet, such as a photograph or other picture, which may be sandwiched between the decorative panel and the backing panel so as to be visible through the aperture in the decorative panel. The decorative panel may be separately formed from the backing panel and secured thereto, for example by an adhesive. Preferably, however, the decorative panel is integral with the backing panel, the two panels being integrally formed from a single sheet of material folded together so that one panel overlies the other.

In the case where the decorative panel is formed with an internal aperture, one side edge of the decorative panel is preferably unsecured to the backing panel, along at least apart of its length, to allow a decorative sheet, such as a photograph, to be inserted between the panels so as to be visible through the aperture in the decorative panel.

Spacer means may be provided to space the decorative panel slightly from the backing panel, to facilitate insertion of a decorative sheet between them. For example, the spacer means may comprise elongate ridges integrally formed on one of said panels.

The backing panel may conveniently be formed with a cut-out recess along a side edge thereof, to facilitate removal of a decorative sheet from the space between the two panels.

DETAILED DESCRIPTION OF THE PREFERRED EMBODIMENTS

Figure 1:
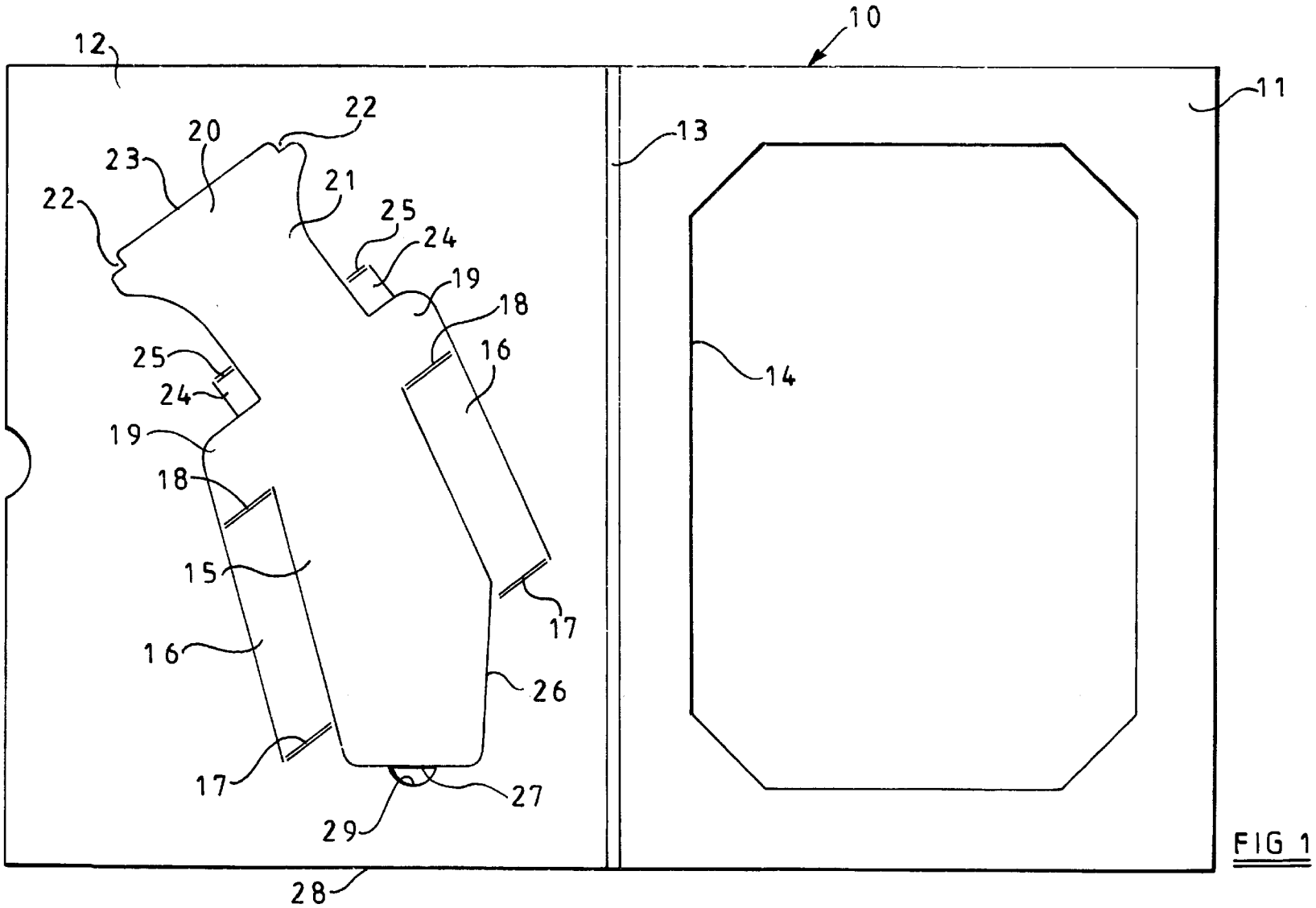
FIG. 1 is a plan view of one form of combined decorative frame panel and backing and support panel, in accordance with the invention.

Referring to FIG. 1: there is provided a single sheet of card or fiberboard 10 comprising a decorative panel 11 and a backing and support panel 12, the two panels being integrally connected by an elongate creased portion 13 which provides a hinge between the two panels, allowing the decorative panel 11 to be folded across the backing panel 12, the two panels being of corresponding size and shape.

The decorative panel 11 has a central aperture 14 through which, in use, a photograph or other decorative sheet can be seen when the device is assembled. The outer surface of the frame provided by the aperture 14 may be decorated in any suitable fashion. For example decorative lines may be printed and/or embossed around the periphery of the aperture 14 or the frame may be printed with any other decorative design, or simply coloured.

Cut out of the backing panel 12 are an elongate support leg 15 and two stays 16 on either side of the support leg 15. Each stay 16 is integrally connected at its lower end to the panel 12 by a creased portion 17 of the panel which defines a hinge allowing each stay 16 to be bent out of the plane of the panel 12. The upper end of each stay 16 is integrally connected by a similar creased hinge 18 to a laterally projecting tab 19 at the side of the support leg 15.

The upper end of the support leg 15 has a wider head part 20 below which is a narrower neck part 21. The wider head part 20 is notched at its opposite side extremities, as indicated at 22, to form a central projection 23.

At each side of the neck part 21 of the leg 15, adjacent the upper sides of the tabs 19, the panel 12 is integrally formed with two rectangular tags 24 which are integrally connected to the panel 12 by creased fold lines 25, allowing the tags 24 to be bent up from the plane of the panel. The distance between the outermost edges of the two tabs 24 is slightly greater than the width of the projection 23 on the upper end of the support leg 15 but is less than the maximum width of the upper end of the support leg.

At its lower end the support leg 15 is provided with a side edge 26 which is more-or-less parallel to the creased hinge 13 between the two panels and a side edge 27 which is more-or-less parallel to the bottom edge 28 of the backing panel 12. A cut-out recess 29 is formed in the panel 12 adjacent the edge 27 of the support leg 15, so that by inserting a finger into the recess 29 the lower end of the support leg may easily be lifted out of the plane of the panel when the device is to be erected, as will be described in relation to FIG. 2.

It will be appreciated that the components shown in FIG. 1 may be cut and stamped from sheet material in a single operation using readily available sheet cutting tools. The component may therefore be produced in large quantities very cheaply and rapidly.

Figure 2:
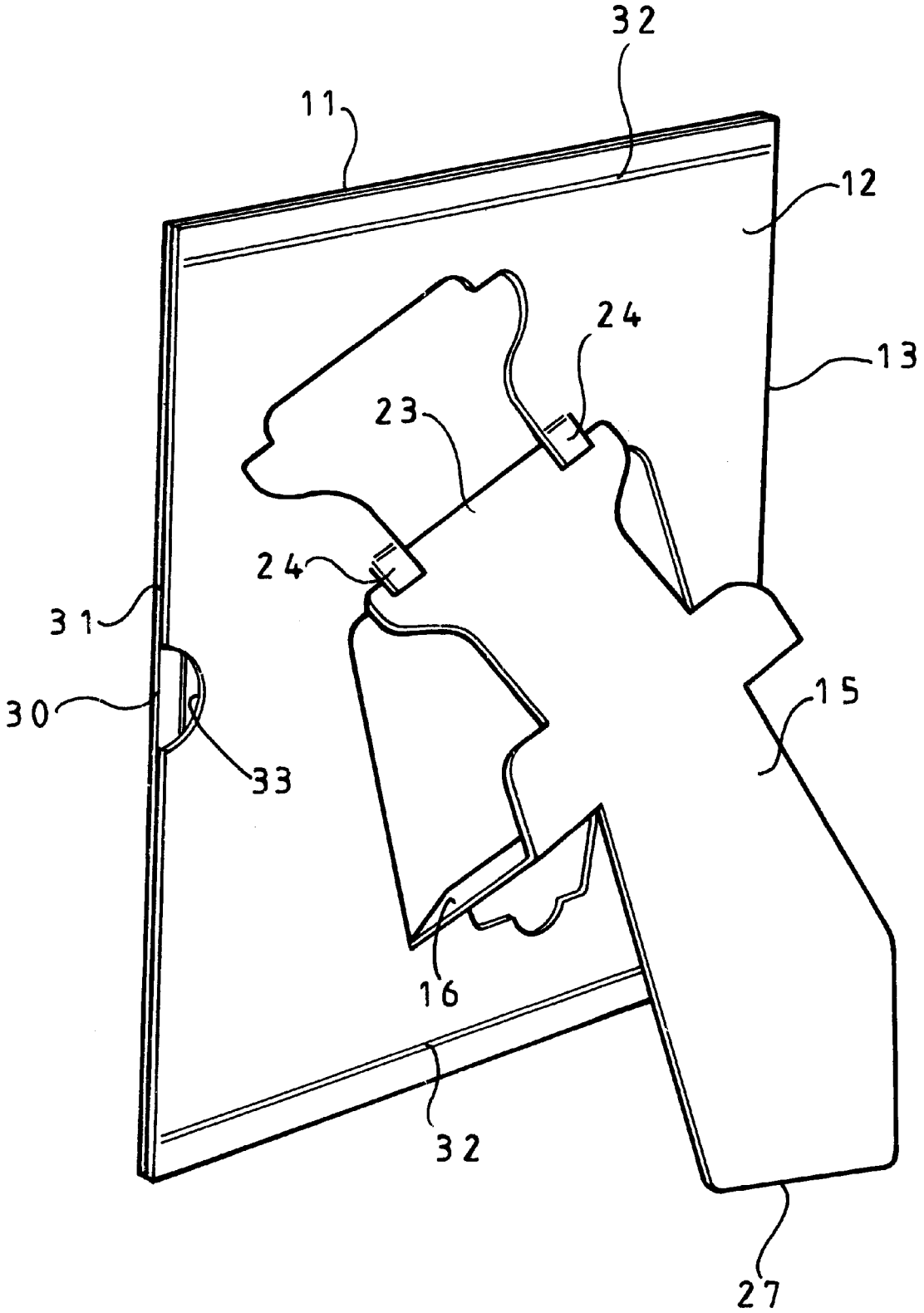
FIG. 2 is a perspective view of the assembly of FIG. 1 in an assembled and erected condition, standing on a horizontal support surface.

FIG. 2 shows a rear view of the component of FIG. 1 in the assembled and erected condition to form a cheap and effective frame for a photograph or the like, which may be stood on any horizontal surface.

In order to provide the frame the decorative apertured panel 11 is folded across the front side of the backing panel 12, using the creased hinge 13, and is glued or otherwise secured along the upper and lower horizontal edges of the backing panel 12, but not along the vertical edge 30, so as to leave a slot 31 through which a photograph or other picture may be slid between the backing panel 12 and front panel 11 so that it can be seen through the aperture 14 in the front panel, which then forms a decorative frame around the picture.

In order to form a slight gap between the panels, so as to facilitate insertion of the picture into the slot 31, the backing panel 12 is formed with embossed recessed lines 32 adjacent the upper and lower edges thereof so as to form a raised ridge on the front side of the panel 12, which engages the inner surface of the panel 11 so as to hold it slightly away from the backing panel to increase the width of the slot 31. The gap between each ridge and the outer edges of the panels is filled with adhesive. It will be appreciated that the embossed lines 32 may be formed at the same time as the support leg 15, aperture 14, etc. are cut from the sheet material.

In order to erect the leg 15, its lower end is pulled out of the plane of the panel 12, swinging the stays 16 outwardly away from the panel 12 and lowering the leg 15 to a position where the outer comers of the projection 23 on its upper part may be introduced beneath the tags 24 on the panel thus serving to retain the leg 15 and stays 16 in the position shown in FIG. 2 where they extend angularly away from the panel. The lower edge 27 of the leg 15 then rests on the horizontal surface supporting the panels 12 and 11 at an appropriate angle so as to display in portrait orientation the photograph sandwiched between them. If it is required to display a photograph in landscape orientation, the assembly can be turned through ninety degrees so that the other edge 26 of the leg 15 rests on the horizontal surface.

A cut-out 33 is formed in the side edge of the backing panel adjacent the slot 31 to facilitate removal of the photograph from between the panels.

Although it is preferred that the decorative frame panel 11 is integrally formed with the backing panel 12, since this reduces the cost of manufacture and facilitates assembly of the frame, it will be appreciated that the frame panel 1 1 might be separately formed from the backing panel and subsequently secured to it by adhesive or by other fixing method. Such an arrangement is particularly suitable where it is desired that the visible frame part of the device be formed from a material which differs from the material of the backing panel 12.

Also, the backing panel 12, integrally formed with the support leg 15, stays 16 and retaining tags 24, might also be used as a backing and support panel for a conventional picture frame made of wood, metal, plastics or other suitable material. In that case the panel 12 can be inserted in the recess at the back of the frame where it is retained by any conventional method.

Although the assembly according to the invention is particularly suitable for use in mounting photographs or other decorative sheets, it will be appreciated that the panel 11, instead of forming a frame for a photograph etc., might itself have a decorative picture or design on its front surface instead of being formed with an aperture to display a photograph etc. For example, the assembly may be a self-supporting picture or greeting card, where the front of the decorative panel 11 is printed with any desired picture, greeting or the like. In this case the two panels 12 and 11 are likely to be formed from thinner card or other material than is the case where they are to receive and frame a photograph or the like.

What is claimed is:

1. A one-piece backing and support assembly for a decorative element, comprising a flat backing panel which provides an elongate support leg cut out from the panel, which support leg has upper and lower ends, and at least one stay also cut out from the panel, the stay having an upper end and a lower end, and being integrally connected at the lower end thereof to the panel and integrally connected at the upper end thereof to a tab projecting laterally from a side of the support leg, which tab is located intermediate the upper and lower ends of the support leg, the upper end of the support leg being detachably engageable with a detent on the panel in a manner to retain the support leg and stay in erected positions where they each extend at an angle away from the panel.

2. An assembly according to claim 1, wherein there are provided two stays cut out from the panel at opposite sides of the support leg, each of the two stays having an upper end, the upper end of each of the two stays being integrally connected to a respective tab, the tabs projecting laterally from opposite sides of the support leg, both said tabs being located intermediate the upper and lower ends of the support leg.

3. An assembly according to claim 1, wherein the upper end of the support leg is formed with a projection which, in the erected position of the leg, is engageable within a cut-out portion of the panel.

4. An assembly according to claim 1, wherein the panel is formed with a recess adjacent an edge of the support leg, to facilitate lifting of the support leg from a plane of the panel.

5. An assembly according to claim 1, wherein the panel is pre-creased, to form a hinge, at a junction between the stay and the support leg and a junction between the stay and the panel.

6. An assembly according to claim 1, wherein the upper end of the support leg is formed with a projection which is detachably engageable within a cut-out portion of the backing panel in a manner to retain the support leg and stay in erected positions where they each extend at an angle away from the panel, the cut-out portion of the panel being formed from at least one tag which is partly cut from the panel and, when bent out of a plane of the panel, reveals said cut-out, whereby the projection on the support leg engages the cut-out portion beneath the tag.

7. An assembly according to claim 1, wherein the lower end of the support leg is formed with two edge portions, each edge portion extending generally parallel to a respective adjacent side edge of the panel, whereby either of said edge portions of the lower end of the support leg may rest on a surface on which the assembly is supported, according to an orientation of the assembly.

8. A one-piece backing and support assembly for a decorative element, comprising a flat backing panel which provides an elongate support leg cut out from the panel, which support leg has upper and lower ends, and at least one stay also cut out from the panel, the at least one stay having an upper end and a lower end, and being integrally connected at the lower end thereof to the panel and at the upper end thereof to a part of the support leg intermediate the upper and lower ends of the support leg, the upper end of the support leg being formed with a projection which is detachably engageable within a cut-out portion of the panel in a manner to retain the support leg and stay in erected positions where they each extend at an angle away from the panel, the cut-out portion of the panel being formed from at least one tag which is partly cut from the panel and, when bent out of plane of the panel, reveals said cut-out, whereby the projection on the support leg engages the cut-out portion beneath the tag.

9. An assembly according to claim 8, wherein the panel is formed with two spaced tags beneath which different spaced portions of the projection on the upper end of the support leg are engageable.

10. An assembly according to claim 9, wherein the upper end of the support leg is wider than a lower neck portion of the support leg, and said tags are located at opposite sides of a portion of the panel from which said lower neck portion of the support leg was cut, so that in the erected position of the leg the wider upper end of the support leg overlaps the portion of the panel from which said lower neck portion of the support leg was cut and is engageable beneath said tags.

11. A decorative assembly comprising a decorative panel and a one-piece backing and support assembly for the decorative panel, the backing and support assembly comprising a flat backing panel which provides an elongate support leg cut out from the backing panel, which support leg has upper and lower ends, and at least one stay also cut out from the backing panel, the stay having upper and lower ends, and being integrally connected at the lower end thereof to the backing panel and at the upper end thereof to a part of the support leg intermediate the upper and lower ends of the support leg, the upper end of the support leg being detachably engageable with a detent on the backing panel in a manner to retain the support leg and stay in erected positions where they each extend at an angle away from the backing panel, with the stay extending upwardly away from the backing panel towards said part of the support leg, the decorative panel being substantially the same size and shape as the backing panel and being connected to the backing panel so as to overlie at least a part of one face of the panel.

12. An assembly according to claim 11, wherein the decorative panel includes an internal aperture so as to define a frame whereby, in use, a picture may be sandwiched between the decorative panel and the backing panel so as to be visible through the aperture in the decorative element.

13. An assembly according to claim 12, wherein the decorative panel is integral with the backing panel, the two panels being integrally formed from a single sheet of material folded together so that one panel overlies the other.

14. An assembly according to claim 12, wherein one side edge of the decorative panel is unsecured to the backing panel, along at least a part of a length thereof, to allow a picture to be inserted between the panels so as to be visible through the aperture in the decorative panel.

15. An assembly according to claim 12, wherein spacer means are provided to space the decorative panel slightly from the backing panel, to facilitate insertion of a picture between the decorative panel and the backing panel.

16. An assembly according to claim 15, wherein the spacer means comprise elongate ridges integrally formed on one of said panels.

* * * * *